US010337799B2

(12) United States Patent
Taras

(10) Patent No.: US 10,337,799 B2
(45) Date of Patent: Jul. 2, 2019

(54) DUAL DUTY MICROCHANNEL HEAT EXCHANGER

(71) Applicant: Carrier Corporation, Farmington, CT (US)

(72) Inventor: Michael F. Taras, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/039,087

(22) PCT Filed: Sep. 24, 2014

(86) PCT No.: PCT/US2014/057147
§ 371 (c)(1),
(2) Date: May 25, 2016

(87) PCT Pub. No.: WO2015/076927
PCT Pub. Date: May 28, 2015

(65) Prior Publication Data

US 2016/0290730 A1 Oct. 6, 2016

Related U.S. Application Data

(60) Provisional application No. 61/908,265, filed on Nov. 25, 2013.

(51) Int. Cl.
*B60H 1/00* (2006.01)
*F28D 7/10* (2006.01)
(Continued)

(52) U.S. Cl.
CPC ..... *F28D 7/0091* (2013.01); *F25B 39/00* (2013.01); *F28D 1/0435* (2013.01);
(Continued)

(58) Field of Classification Search
CPC .... F28D 1/0435; F28D 1/0408; F28D 1/0417; F28D 1/0426; F28D 1/0443;
(Continued)

(56) References Cited

U.S. PATENT DOCUMENTS 4,328,861 A 5/1982 Cheong et al.
4,736,597 A 4/1988 Anderson et al.
(Continued)

FOREIGN PATENT DOCUMENTS

CA 2240897 A1 7/1997
CA 2537864 A1 12/2006
(Continued)

OTHER PUBLICATIONS

International Search Report and Written Opinion for application PCT/US2014/057147, dated Jan. 23, 2015, 9 pages.
(Continued)

*Primary Examiner* — Jason N Thompson
(74) *Attorney, Agent, or Firm* — Cantor Colburn LLP

(57) ABSTRACT

A heat exchanger includes a first tube bank having at least a first and a second flattened tube segments extending longitudinally in spaced parallel relationship. A second tube bank includes at least a first group of flattened tube segments and a second group of flattened tube segments extending longitudinally in spaced parallel relationship. The second tube bank is disposed behind the first tube bank with a leading edge of the second tube bank spaced from a trailing edge of the first tube bank. The first group of flattened tube segments is configured to receive a first fluid. The second group of flattened tube segments is configured to receive a second fluid. A fan provides an airflow across the first tube bunk and the second tube bank sequentially.

12 Claims, 9 Drawing Sheets

(51) Int. Cl.

| | |
|---|---|
| ***F25B 39/04*** | (2006.01) |
| ***F28D 7/00*** | (2006.01) |
| ***F28D 1/04*** | (2006.01) |
| ***F28D 1/053*** | (2006.01) |
| ***F28F 1/12*** | (2006.01) |
| ***F25B 39/00*** | (2006.01) |
| *F28D 21/00* | (2006.01) |
| *F25B 39/02* | (2006.01) |
| *F25B 40/02* | (2006.01) |
| *F25B 40/06* | (2006.01) |

(52) U.S. Cl.
CPC ..... *F28D 1/05391* (2013.01); *F28F 1/126* (2013.01); *F25B 39/02* (2013.01); *F25B 39/04* (2013.01); *F25B 40/02* (2013.01); *F25B 40/06* (2013.01); *F28D 2021/0068* (2013.01); *F28F 2260/02* (2013.01)

(58) Field of Classification Search
CPC ..... F28D 1/0452; F25B 2400/05; F25B 2400/054; F25B 2339/047; F28F 2210/04
USPC ..... 165/41, 140; 62/506
See application file for complete search history.

(56) References Cited

U.S. PATENT DOCUMENTS 4,770,240 A 9/1988 Dawson et al.
4,901,537 A 2/1990 Yoshikawa et al.
5,033,540 A 7/1991 Tategami et al.
5,046,554 A 9/1991 Iwasaki et al.
5,058,662 A 10/1991 Nguyen
5,076,353 A 12/1991 Haussmann
5,186,244 A 2/1993 Josh
5,348,081 A 9/1994 Halstead et al.
5,509,199 A 4/1996 Beamer et al.
5,538,079 A 7/1996 Pawlick
5,727,618 A 3/1998 Mundinger et al.
5,876,667 A 3/1999 Gremel et al.
5,915,471 A 6/1999 Kim
5,941,303 A 8/1999 Gowan et al.
6,189,603 B1 2/2001 Sugimoto et al.
6,213,196 B1 4/2001 Ozaki et al.
6,343,645 B1 * 2/2002 Baumann ..... F28D 1/0391 165/140
6,357,519 B1 3/2002 Ozaki et al.
6,439,300 B1 8/2002 Falta et al.
6,523,606 B1 2/2003 Dienhart et al.
6,536,517 B2 3/2003 Hoshino et al.
6,540,016 B1 4/2003 Baldantoni
6,895,770 B1 5/2005 Kaminski
6,964,296 B2 11/2005 Memory et al.
7,036,561 B2 5/2006 Yagi et al.
7,275,394 B2 10/2007 Landberg
7,284,594 B2 10/2007 Sanada et al.
7,360,309 B2 4/2008 Vaidyanathan et al.
7,578,340 B2 8/2009 Forster et al.
7,587,340 B2 8/2009 Forster et al.
7,640,966 B2 1/2010 Maeda et al.
7,669,557 B2 3/2010 Kojima
7,721,794 B2 5/2010 Heidenreich et al.
7,836,944 B2 11/2010 Antonijevic et al.
8,365,809 B2 2/2013 Sugimoto et al.
2002/0129929 A1 * 9/2002 Iwasaki ..... F28D 1/0435 165/152
2004/0182558 A1 9/2004 Watanabe et al.
2004/0206490 A1 10/2004 Katoh et al.
2005/0006067 A1 * 1/2005 Hoglinger ..... F28D 1/0417 165/140
2005/0072562 A1 4/2005 Hall
2005/0217839 A1 * 10/2005 Papapanu ..... F28D 1/0443 165/185
2005/0269062 A1 * 12/2005 Guerrero ..... F28D 1/0452 165/101
2006/0053833 A1 * 3/2006 Martins ..... F25B 39/04 62/507
2006/0277940 A1 12/2006 Jang et al.
2007/0163766 A1 7/2007 Fischer et al.
2007/0193731 A1 8/2007 Lamich et al.
2007/0227714 A1 10/2007 Takeuchi et al.
2008/0023187 A1 1/2008 Kirschenmann
2008/0073061 A1 3/2008 Dias et al.
2008/0078198 A1 4/2008 Breiding et al.
2008/0229580 A1 9/2008 Anderson et al.
2009/0025914 A1 1/2009 Knight et al.
2009/0078399 A1 * 3/2009 Makita ..... F28D 1/0443 165/173
2009/0114379 A1 5/2009 Lim et al.
2009/0173479 A1 7/2009 Huang et al.
2009/0211288 A1 8/2009 Simeone et al.
2009/0211743 A1 8/2009 Schrader et al.
2010/0012307 A1 1/2010 Taras et al.
2010/0071868 A1 3/2010 Reifel et al.
2010/0212874 A1 8/2010 Min et al.
2010/0236766 A1 9/2010 Ulics, Jr. et al.
2010/0270012 A1 10/2010 Hur et al.
2010/0326100 A1 * 12/2010 Taras ..... F25B 1/10 62/115
2011/0048689 A1 3/2011 Johnson et al.
2011/0059523 A1 * 3/2011 Knight ..... B01J 8/008 435/325
2011/0061844 A1 3/2011 Jianlong et al.
2011/0073292 A1 3/2011 Datta et al.
2011/0088885 A1 4/2011 Samuelson et al.
2011/0108260 A1 5/2011 Alahyari et al.
2011/0120177 A1 5/2011 Kirkwood et al.
2011/0139414 A1 6/2011 Ghosh et al.
2011/0203780 A1 8/2011 Jiang et al.
2012/0080173 A1 * 4/2012 Koberstein ..... F28D 1/0435 165/173
2012/0168125 A1 7/2012 Johnston et al.
2012/0222848 A1 * 9/2012 Sicks ..... F28F 9/0204 165/173
2013/0023533 A1 1/2013 Wunberg et al.
2015/0027677 A1 1/2015 Taras et al.
2016/0003545 A1 1/2016 Taras et al.

FOREIGN PATENT DOCUMENTS

CN 1119267 A 3/1996
CN 1287607 A 3/2001
CN 2709909 Y 7/2005
CN 2754040 Y 1/2006
CN 1877221 A 12/2006
CN 1914473 A 2/2007
CN 101124038 A 2/2008
CN 101298951 A 11/2008
CN 201229094 Y 4/2009
CN 101517349 A 8/2009
CN 201387254 Y 1/2010
CN 101706225 A 5/2010
CN 101738010 A 6/2010
CN 201764878 U 3/2011
CN 102207347 A 10/2011
CN 102243028 A 11/2011
CN 202109780 U 1/2012
CN 202361699 U 8/2012
CN 202648260 U 1/2013
DE 102005004284 A1 8/2005
DE 102007035111 A1 1/2009
DE 10150213 A1 5/2013
EP 0096127 A1 12/1983
EP 0175836 4/1986
EP 0330701 A2 9/1989
EP 0962736 A2 12/1999
EP 1065453 A2 1/2001
EP 1111318 A1 6/2001
EP 1447636 A1 8/2004
EP 1657513 A1 5/2006
EP 1795847 A2 6/2007
EP 2336701 A2 6/2011
EP 2362176 A2 8/2011

(56) References Cited

FOREIGN PATENT DOCUMENTS

| | | | | |
|---|---|---|---|---|
| EP | 2372289 | A2 | 10/2011 | |
| EP | 1840494 | A2 | 10/2013 | |
| FR | 2798990 | A1 | 3/2001 | |
| FR | 2913490 | A1 | 9/2008 | |
| GB | 1355653 | A | 6/1974 | |
| GB | 1492408 | A | 11/1977 | |
| GB | 2356040 | A | 5/2001 | |
| JP | H1089874 | A | 4/1998 | |
| JP | H10300271 | A | 11/1998 | |
| JP | H11325790 | A | 11/1999 | |
| JP | 2000028228 | A | 1/2000 | |
| JP | 2001099593 | A | 4/2001 | |
| JP | 2006343088 | A | 12/2006 | |
| JP | 2007515777 | A | 6/2007 | |
| JP | 2008116107 | A | 5/2008 | |
| KR | 20020032818 | A | 5/2002 | |
| KR | 20040051645 | A | 6/2004 | |
| KR | 100697088 | B1 | 3/2007 | |
| KR | 20070120263 | A | 12/2007 | |
| KR | 20080008542 | A | 1/2008 | |
| KR | 20080021298 | A | 3/2008 | |
| WO | 9725079 | A1 | 7/1997 | |
| WO | 02068890 | A1 | 9/2002 | |
| WO | 2005003668 | A2 | 1/2005 | |
| WO | 2005015110 | A1 | 2/2005 | |
| WO | 2005100901 | A1 | 10/2005 | |
| WO | 2006035149 | A1 | 4/2006 | |
| WO | 2008042368 | A1 | 4/2008 | |
| WO | 2008105760 | A2 | 9/2008 | |
| WO | 2009078869 | A1 | 6/2009 | |
| WO | 2009105454 | A2 | 8/2009 | |
| WO | 2010019401 | A2 | 2/2010 | |
| WO | 2011025988 | A2 | 3/2011 | |
| WO | 2011034633 | A1 | 3/2011 | |
| WO | 2011041600 | A1 | 4/2011 | |
| WO | 2011042344 | A2 | 4/2011 | |
| WO | 2011069015 | A2 | 6/2011 | |
| WO | WO 2011139425 | A2 * | 11/2011 | ..... F25B 1/10 |

OTHER PUBLICATIONS

Chinese Office Action and Search Report for application CN 201380071339.2, dated Dec. 2, 2016, pp. 1-10.

Chinese Office Action for application 201480064112.1, dated Nov. 3, 2017, pp. 1-15.

Chinese Office Action with translation for application CN 201380007736.5, dated Oct. 13, 2017, pp. 1-20.

CN Office Action with translation, Application No. 201380007736.5, dated Jan. 11, 2016, pp. 1-19.

CN Office Action with translation, Application No. 201380007736.5, dated Jan. 19, 2017, pp. 1-22.

CN Office Action with translation, Application No. 201380007736.5, dated Jul. 13, 2016, pp. 1-20.

CN Second Chinese Office Action and Search Report with translation for application CN 201380071389.2, dated Aug. 22, 2017, pp. 1-20.

International Search Report and Written Opinion for Application No. PCT/US2013/023533, dated Sep. 9, 2013, 9 Pages.

International Search Report for application PCT/US2013/071644 dated Feb. 19, 2014, 5 pages.

IPRP: International Application No. PCT/US2013/023533; International Filing Date: Jan. 29, 2013; dated Aug. 5, 2014, pp. 1-6.

IPRP; International Application No. PCT/US2013/071644; International Filing Date: Nov. 25, 2013; dated Jul. 28, 2015, pp. 1-6.

PCT International Preliminary Report on Patentability; International Application No. PCT/US2014/057147; International Filing Date: Sep. 24, 2014, dated May 31, 2016, pp. 1-6.

U.S. Office Action; U.S. Appl. No. 14/376,195; Final Office Action; dated Dec. 15, 2017, pp. 1-24.

U.S. Office Action; U.S. Appl. No. 14/376,195; Non-Final Office Action; dated Jul. 13, 2017, pp. 1-22.

U.S. Office Action; U.S. Appl. No. 14/763,557; Non-Final Office Action; dated Nov. 8, 2017, pp. 1-22.

Written Opinion for application PCT/US2013/071644 dated Feb. 19, 2014, 5 pages.

CN Decision of Reexamination with Translation; CN Appplication No. 201380007736.5; dated Feb. 1, 2018; pp. 1-34.

CN Office Action with Translation; CN Appplication No. 201380071389.2; dated Feb. 28, 2018; pp. 1-41.

U.S. Non-Final Office Action for U.S. Appl. No. 14/376,195, filed Aug. 1, 2014, dated May 3, 2018, pp. 1-46.

Chinese Fourth Office Action with English Translation; CN Application No. 201380071389.2; dated Jul. 13, 2018; pp. 1-6.

Second Office Action for Chinese Patent Application No. 201480064112.1, dated Jun. 8, 2018, with English Translation (24 pp.).

* cited by examiner

DUAL DUTY MICROCHANNEL HEAT EXCHANGER

CROSS-REFERENCE TO RELATED APPLICATION

This application claims the benefit of U.S. provisional patent application Ser. No. 61/908,265 filed Nov. 25, 2013, the entire contents of which are incorporated herein by reference.

BACKGROUND

This invention relates generally to heat exchangers and, more particularly, to dual duty multiple tube bank heat exchanger for use in heating, ventilation, air conditioning and refrigeration (HVAC&R) systems.

Refrigerant vapor compression systems are well known in the art. Air conditioners and heat pumps employing refrigerant vapor compression cycles are commonly used for cooling or cooling/heating air supplied to a climate-controlled comfort zone within a residence, office building, hospital, school, restaurant or other facility. Refrigerant vapor compression systems are also commonly used for cooling air or other secondary fluid to provide a refrigerated environment for food items and beverage products within, for instance, display cases in supermarkets, convenience stores, groceries, cafeterias, restaurants and other food service establishments. In the case of refrigerated trucks, a transport refrigeration system is mounted behind or on the roof of the truck and is configured to maintain a controlled temperature environment within the cargo box of the truck. In the case of refrigerated trailers, which are typically pulled behind a tractor cab, a transport refrigeration system is mounted generally to the front wall of the trailer and is configured to maintain a controlled temperature environment within the cargo box of the trailer.

Commonly, these refrigerant vapor compression systems include a compression device, a refrigerant heat rejection heat exchanger, an expansion device and a refrigerant heat absorption heat exchanger connected in serial refrigerant flow communication in a refrigerant vapor compression cycle. In a subcritical refrigerant vapor compression cycle, the refrigerant heat rejection heat exchanger functions as a condenser. In a transcritical refrigerant vapor compression cycle, however, the refrigerant heat rejection heat exchanger functions as a gas cooler. In either a subcritical or transcritical refrigerant vapor compression cycle, the refrigerant heat absorption heat exchanger functions as an evaporator. Additionally, conventional refrigerant vapor compression systems sometimes include one or more refrigerant-to refrigerant heat exchangers, for example, an economizer heat exchanger or a suction line-to-liquid line heat exchanger, or air-to-refrigerant heat exchanger, such as a reheat heat exchanger, variable frequency drive cooler or an intercooler. Furthermore, if the refrigerant system is driven by an engine, other heat exchangers such radiator or turbo-charger/supercharger cooler may be included.

Historically, the refrigerant heat rejection heat exchanger and the refrigerant heat absorption heat exchanger used in such refrigerant vapor compression systems have been round tube and plate fin heat exchangers constituting a plurality of round tubes, disposed in a desired circuiting arrangement, with each circuit defining a refrigerant flow path extending between a pair of headers or manifolds. Thus, a round tube and plate fin heat exchanger with conventional round tubes will have a relatively small number of large flow area refrigerant flow paths extending between the headers.

More recently, flat, rectangular, racetrack, or oval shape, multi-channel tubes are being used in heat exchangers for refrigerant vapor compression systems. Sometimes, such multi-channel heat exchanger constructions are referred to as microchannel or minichannel heat exchangers as well. Each multi-channel tube has a plurality of flow channels extending longitudinally in parallel relationship the length of the tube, each channel defining a small cross-sectional flow area refrigerant path. Thus, a heat exchanger with multi-channel tubes extending in parallel relationship between a pair of headers or manifolds of the heat exchanger will define a relatively large number of small cross-sectional flow area refrigerant paths extending between the two headers. To provide a multi-pass flow arrangement within a multi-channel heat exchanger core, the headers, which in some embodiments may be intermediate manifolds, may be divided into a number of chambers, which depends on a desired number of refrigerant passes.

Conventional refrigeration applications, such as a transport refrigeration system for example, include a plurality of separate heat exchangers. Each of these heat exchangers includes different design requirements and is manufactured separately prior to being installed into the heat exchanger assembly. These heat exchangers may be constructed as single slab micro-channel heat exchangers. As a result, the increased design complexity, additional components and installation time required to assemble and integrate the heat exchangers into the system increase the cost of the assembly significantly. Therefore a more simplified, cost effective and thermally advanced multiple duty heat exchanger is required.

SUMMARY OF THE INVENTION

An embodiment of the invention is provided including a heat exchanger having a first tube bank having at least a first and a second flattened tube segments extending longitudinally in spaced parallel relationship. A second tube bank includes at least a first group of flattened tube segments and a second group of flattened tube segments extending longitudinally in spaced parallel relationship. The second tube bank is disposed behind the first tube bank with a leading edge of the second tube bank spaced from a trailing edge of the first tube bank. The first group of flattened tube segments receives a first fluid. The second group of flattened tube segments receives a second fluid. A fan provides an airflow across the first tube bank and the second tube bank in sequence.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
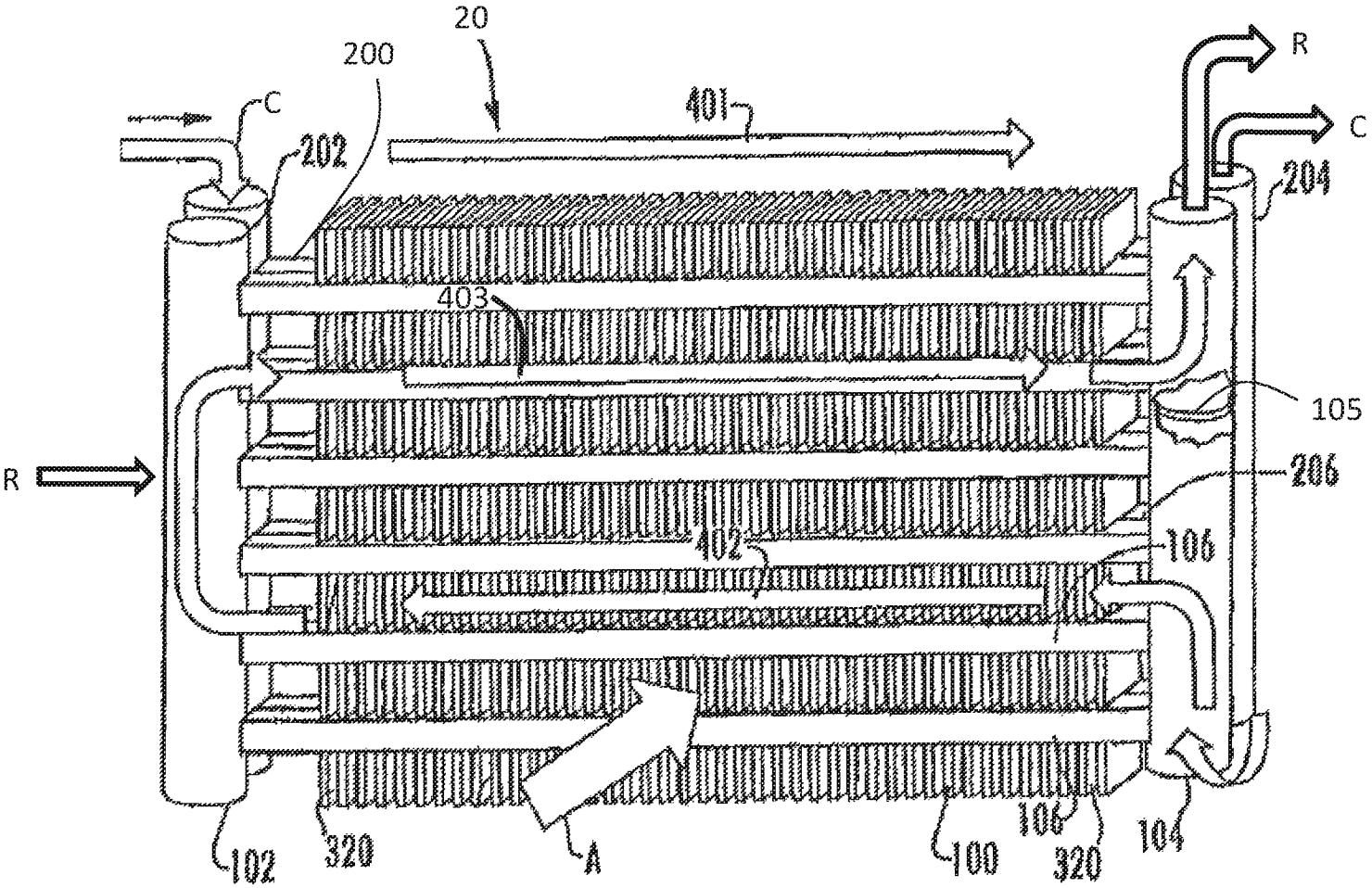
FIG. 1 is a perspective view of a multiple tube bank, flattened tube finned heat exchanger according to an embodiment of the invention.

The detailed description explains embodiments of the invention, together with advantages and features, by way of example with reference to the drawings.

DETAILED DESCRIPTION

Referring now to FIGS. 1-4 an example of a multiple bank flattened tube finned heat exchanger configured to receive at least two fluids is shown. In the illustrated, non-limiting embodiment, the heat exchanger 20 includes a first tube bank 100 and a second tube bank 200. The second tube bank 200 is disposed behind the first tube bank 100 and is downstream with respect to an airflow, A, through the heat exchanger 20. The first tube bank 100 may also be referred to herein as the front heat exchanger slab 100 and the second tube bank 200 may also be referred to herein as the rear heat exchanger slab 200. Although the multi-bank heat exchanger 20 illustrated and described herein includes a first and second tube bank 100, 200, a heat exchanger 20 having any number of tube banks is within the scope of the invention.

Figure 3:
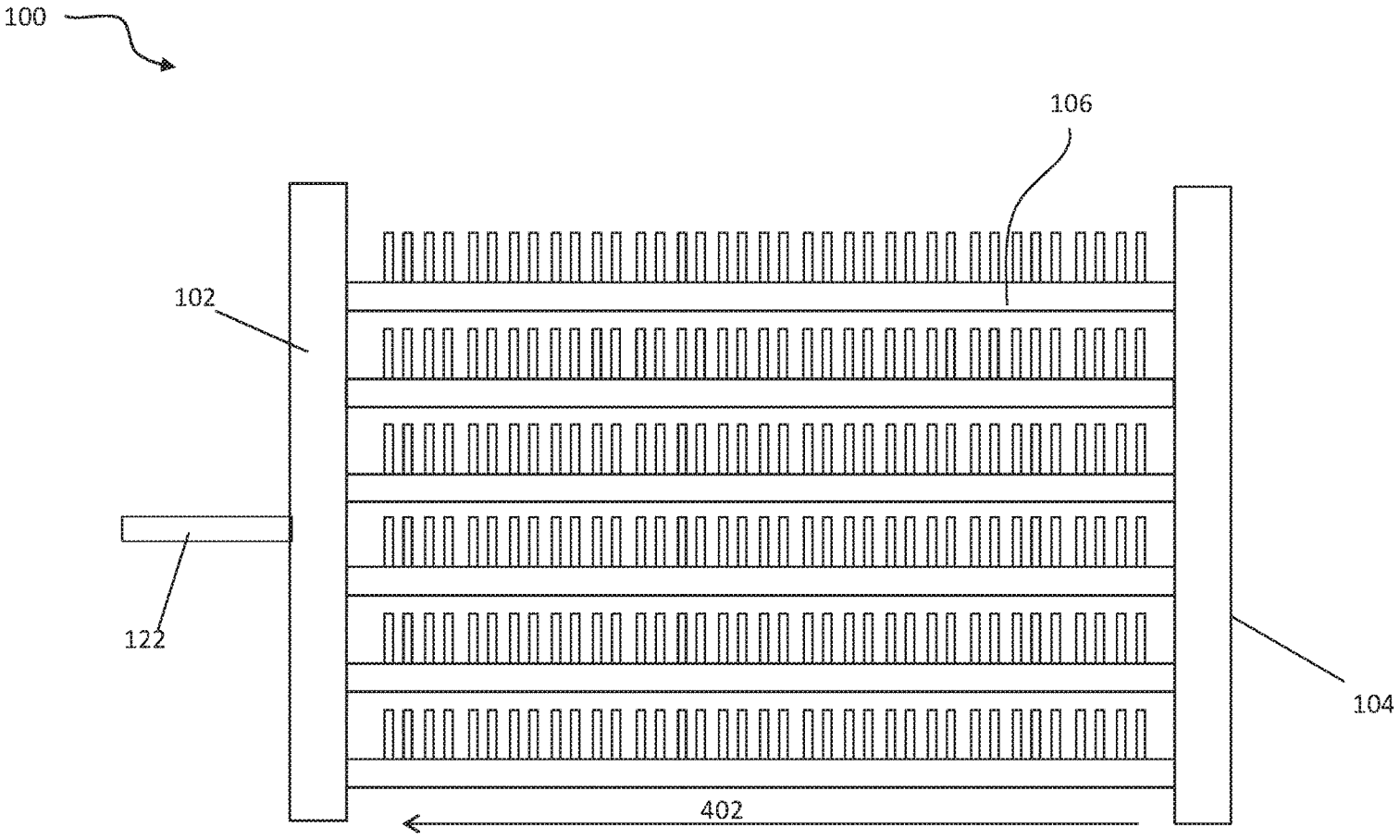
FIG. 3 is a side view of a first tube bank of the multiple tube bank flattened tube finned heat exchanger according to an embodiment of the invention.
Figure 3A:
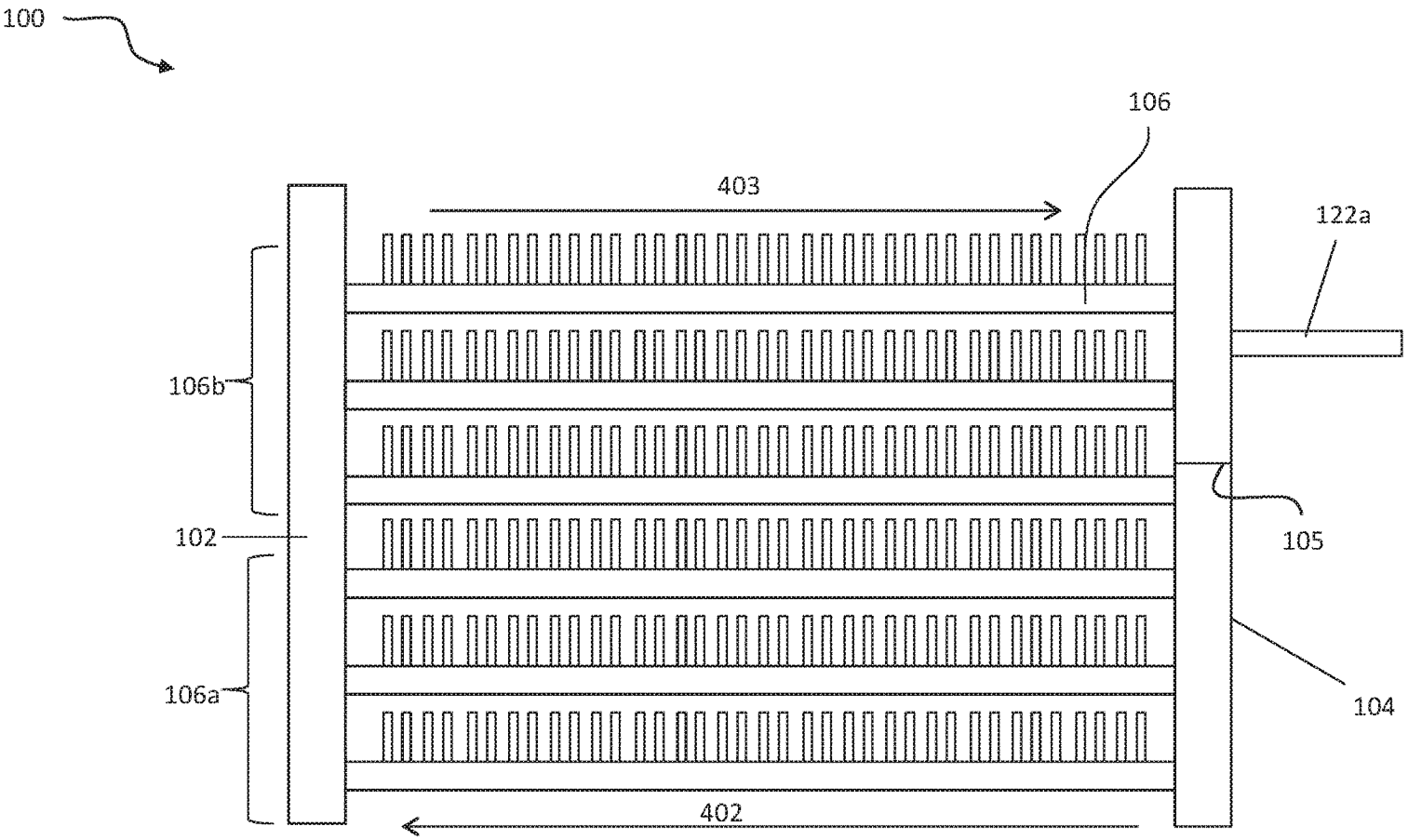

The first tube bank 100, illustrated in FIGS. 3 and 3*a*, includes a first manifold 102, a second manifold 104 spaced apart from the first manifold 102, and a plurality of heat exchange tube segments 106, including at least a first and a second tube segment, extending longitudinally in spaced parallel relationship between and connecting the first manifold 102 and the second manifold 104 in fluid communication. As shown in the FIG. 3, the first tube bank 100 may be configured in a single pass arrangement such that fluid flows from the second manifold 104 to the first manifold 102 and an outlet 122 through the plurality of heat exchange tube segments 106, in the fluid flow direction indicated by arrow 402. In another embodiment, shown in FIG. 3*a*, the first tube bank 100 may be configured in a multi-pass flow arrangement. For example, with the addition of a baffle or partition 105 in the second manifold 104, the first tube bank 100 generally includes a two-pass configuration. Fluid is configured to flow from the second manifold 104 to the first manifold 102 in the direction indicated by arrow 402 through a first, lower portion 106*a* of heat exchanger tube segments 106 and back to the second manifold 104 and outlet 122*a* through a second, upper portion 106*b* of heat exchanger tube segments 106, in the direction indicated by arrow 403.

Figure 4:
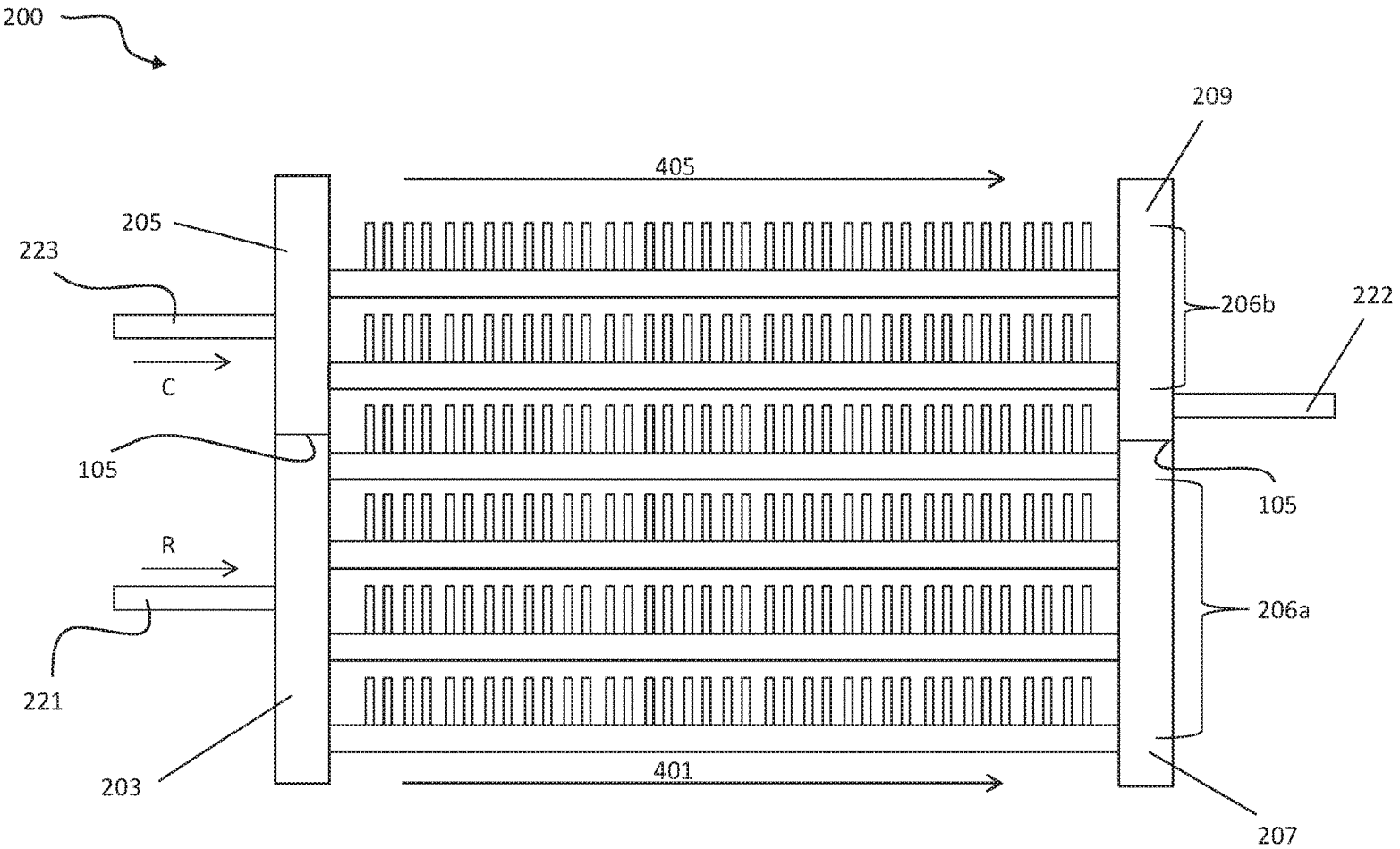
FIG. 4 is a side view of a second tube bank of the multiple tube bank flattened tube finned heat exchanger according to an embodiment of the invention.

As illustrated in FIG. 4, the second tube bank 200 includes a first manifold 202 (FIG. 1) spaced apart from a second manifold 204 (FIG. 1), and a plurality of heat exchange tube segments 206, including at least a first and a second tube segment. In one embodiment, the first manifold 202 includes at least one baffle 105 such that the first manifold 202 is divided into a plurality of chambers, such as a chamber 203 and a chamber 205 for example. Similarly, the second manifold 204 includes at least one baffle 105 such that the second manifold 204 also includes a plurality of chambers, such as chambers 207 and 209 for example. A first portion 206*a* of the plurality of tube segments 206 extends longitudinally in spaced parallel relationship between and fluidly connecting chamber 203 of the first manifold 202 with the chamber 207 of the second manifold 204 and a second portion 206*b* of the plurality of tube segments 206 extends longitudinally in spaced parallel relationship between and fluidly coupling chamber 205 of the first manifold 202 with chamber 209 of the second manifold 204. Although the multi-bank heat exchanger 20 illustrated and described herein includes a first portion 206*a* and a second portion 206*b* of heat exchanger tube segments, a heat exchanger 20 having any number of portions of heat exchanger tube segments 206 and a pair of chambers fluidly coupled to each portion is within the scope of the invention.

Each set of manifolds 102, 202, 104, 204 disposed at either side of the heat exchanger 20 may comprise separate paired manifolds, may comprise separate chambers within an integral one-piece folded manifold assembly or may comprise separate chambers within an integral fabricated (e.g. extruded, drawn, rolled and welded) manifold assembly. Each tube bank 100, 200 may further include guard or "dummy" tubes (not shown) extending between its first and second manifolds at the top of the tube bank and at the bottom of the tube bank. These "dummy" tubes do not convey refrigerant flow, but add structural support to the tube bank and protect the uppermost and lowermost fins.

Figure 2:
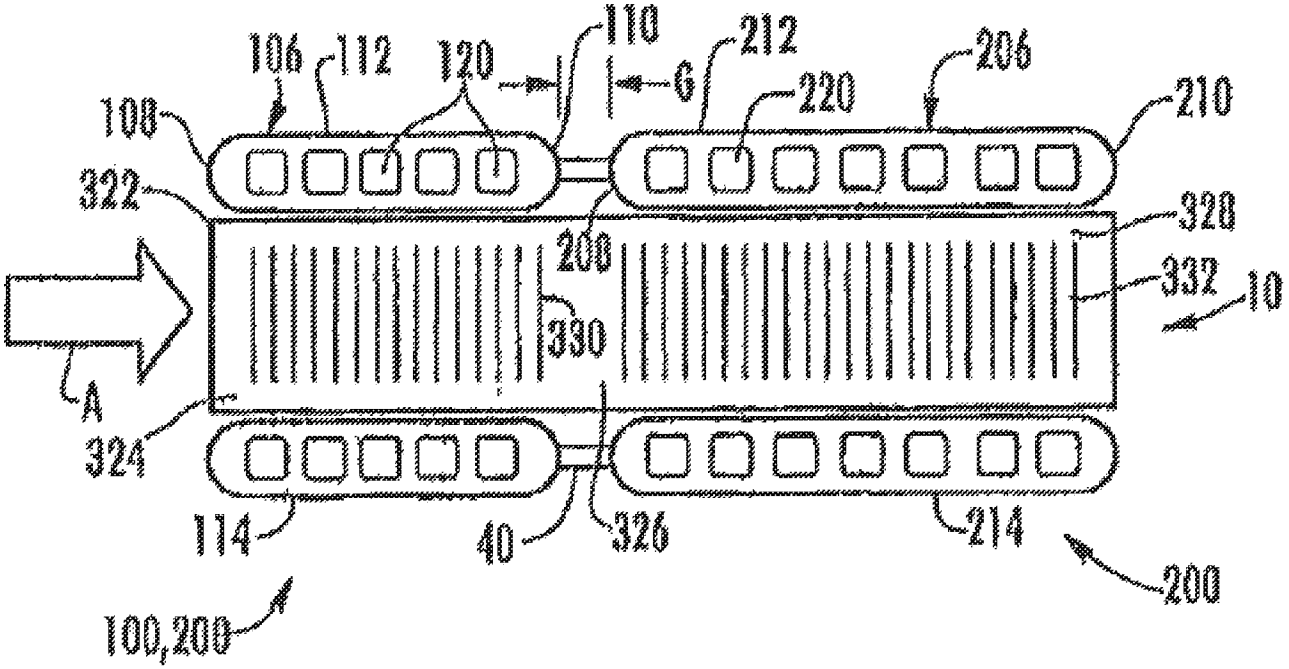
FIG. 2 is a side view, partly in section, illustrating a fin and a set of integral flattened tube segment assemblies of the heat exchanger of FIG. 1.

Referring now to FIG. 2, each of the heat exchange tube segments 106, 206 comprises a flattened heat exchange tube having a leading edge 108, 208, a trailing edge 110, 210, an upper surface 112, 212, and a lower surface 114, 214. The leading edge 108, 208 of each heat exchange tube segment 106, 206 is upstream of its respective trailing edge 110, 210 with respect to airflow through the heat exchanger 20. In the embodiment depicted in FIG. 2, the respective leading and trailing portions of the flattened tube segments 106, 206 are rounded thereby providing blunt leading edges 108, 208 and trailing edges 110, 210. However, it is to be understood that the respective leading and trailing portions of the flattened tube segments 106, 206 may be formed in other configurations.

The interior flow passage of each of the heat exchange tube segments 106, 206 of the first and second tube banks 100, 200, respectively, may be divided by interior walls into a plurality of discrete flow channels 120, 220 that extend longitudinally over the length of the tube segment 106, 206 from an inlet end to an outlet end and establish fluid communication between the respective manifolds 102, 104, 202, 204 of the first and the second tube banks 100, 200. The heat exchange tube segments 206 of the second tube bank 200 may have a width substantially equal to or different from the width of the tube segments 106 of the first tube bank 100. Although the tube segments 206 of the second tube bank 200, illustrated in FIG. 2, are wider than the tube segments of the first tube bank 100, other configurations where the tube segments 106 of the first tube bank 100 are wider than the tube segments 206 of the second tube bank 200 are within the scope of the invention. Also, the interior flow passages of the wider heat exchange tube segments 206 may be divided into a greater number of discrete flow channels 220 than the number of discrete flow channels 120 into which the interior flow passages of the heat exchange tube segments 106 are divided. The flow channels 120, 220 may have a circular cross-section, a rectangular cross-section, a trapezoidal cross-section, a triangular cross-section or other non-circular cross-section. The heat exchange tube segments 106, 206 including the discrete flow channels 120, 220 may be formed using known techniques and materials, including, but not limited to, extruded or folded.

The second tube bank 200, i.e. the rear heat exchanger slab, is disposed behind the first tube bank 100, i.e., the front heat exchanger slab, with respect to the airflow direction, with each heat exchange tube segment 106 directly aligned with a respective heat exchange tube segment 206 and with the leading edges 208 of the heat exchange tube segments 206 of the second tube bank 200 spaced from the trailing edges 110 of the heat exchange tube segments of the first tube bank 100 by a desired spacing, G. In embodiments where the tube segments 106 and 206 are fabricated separately and do not have the connecting web 40 (the web 40 typically would have the slots and end notches—not shown), a spacer or a plurality of spacers disposed at longitudinally spaced intervals may be provided between the trailing edges 110 of the heat exchange tube segments 106 and the leading edges 208 of the heat exchange tube segments 206 to maintain the desired spacing, G, during assembly and brazing of the preassembled heat exchanger 20 in a brazed furnace.

In the embodiment depicted in FIG. 2, an elongated web 40 or a plurality of spaced web members 40 span the desired spacing gap, G, along at least of portion of the length of each aligned set of heat exchange tube segments 106, 206. For a further description of a dual bank, flattened tube finned heat exchanger wherein the heat exchange tubes 106 of the first tube bank 100 and the heat exchange tubes 206 of the second tube bank 200 are connected by an elongated web or a plurality of web members, reference is made to U.S. patent application serial number US2013/023533, filed Jan. 29, 2013, the entire disclosure of which is hereby incorporated herein by reference.

Referring still to FIGS. 1-4, the flattened tube finned heat exchanger 20 disclosed herein further includes a plurality of folded fins 320. Each folded fin 320 is formed from a plurality of connected strips or a single continuous strip of fin material tightly folded in a ribbon-like serpentine fashion thereby providing a plurality of closely spaced fins 322 that extend generally orthogonal to the flattened heat exchange tubes 106, 206. Typically, the fin density of the closely spaced fins 322 of each continuous folded fin 320 may be about 16 to 25 fins per inch, but higher or lower fin densities may also be used. Heat exchange between the one or more fluids within the heat exchanger tubes 106, 206 and air flow, A, occurs through the outside surfaces 112, 114 and 212, 214, respectively, of the heat exchange tube segments 106, 206, collectively forming the primary heat exchange surface, and also through the heat exchange surface of the fins 322 of the folded fin 320, which forms the secondary heat exchange surface.

In the depicted embodiment, the depth of each of the ribbon-like folded fin 320 extends at least from the leading edge 108 of the first tube bank 100 to the trailing edge of 210 of the second bank 200, and may overhang the leading edge 108 of the first tube bank 100 or/and trailing edge 208 of the second tube bank 200 if desired. Thus, when a folded fin 320 is installed between a set of adjacent multiple tube, flattened heat exchange tube assemblies, a first section 324 of each fin 322 is disposed within the first tube bank 100, a second section 326 of each fin 322 spans the spacing, G, between the trailing edge 110 of the first tube bank 100 and the leading edge 208 of the second tube bank 200, and a third section 328 of each fin 322 is disposed within the second tube bank 200. In an embodiment, each fin 322 of the folded fin 320 may be provided with louvers 330, 332 formed in the first and third sections, respectively, of each fin 322.

Referring now to FIG. 2, a cooling media, most commonly ambient air being moved by a fan, is configured to flow over the tube segments and fins 320 of the multiple bank, flattened tube heat exchanger 20 disclosed herein. The air is configured to flow through the airside of the heat exchanger 20 in the direction indicated by arrow "A" and passes over the outside surfaces of the heat exchange tube segments 106, 206 and the surfaces of the folded fin strips 320. The air flow first passes transversely across the upper and lower horizontal surfaces 112, 114 of the heat exchange tube segments 106 of the first tube bank 100, and then passes transversely across the upper and lower horizontal surfaces 212, 214 of the heat exchange tube segments 206 of the second tube bank 200.

Referring now to FIG. 4, the first portion **206*a* of heat exchange tube segments 206 is configured to receive a first fluid and the second portion 206*b* of heat exchange tube segments 206 is configured to receive a second fluid. In embodiments including additional pairs of manifolds and portions of heat exchange tube segments 206**, each portion of heat exchanger tube segments may be configured to receive an additional fluid or receive the fluid from another portion either directly or after being circulated through a system component.

The first fluid is configured to pass through the heat exchanger 20 in a cross-counterflow arrangement relative to the airflow, in that the first fluid provided to chamber 203 of manifold 202 via an inlet 221 passes through the first portion **206*a* of tube segments 206 of the second tube bank 200 to chamber 207 of the second manifold 204. Chamber 207 of the second manifolds 204 of the second tube bank 200 is fluidly coupled to the second manifold 104 of the first tube bank 100 such that the first fluid flows from the second tube bank 200 to the first tube bank 100 and then through at least a portion of the tube segments 106 of the first tube bank 100. The first fluid may be configured to flow through the first tube bank 100 in a single pass configuration indicated by arrow 402 (FIG. 3) or may be configured to flow in a two pass configuration indicated by arrows 402 and 403 (FIG. 3*a*). The chamber 207 of second manifold 204 and a portion of second manifolds 104 may be integrally formed or may be separate manifolds connected by a conduit (not shown). The multiple tube bank, flattened tube finned heat exchanger 20 having a cross-counterflow circuit arrangement yields superior heat exchange performance, as compared to the crossflow or cross-parallel flow circuit arrangements, as well as allows for flexibility to manage the refrigerant side pressure drop via implementation of tubes of various widths within the first tube bank 100 and the second tube bank 200**. The first fluid R may be a refrigerant flowing through a condenser, for example.

The second fluid is configured to pass through the second tube bank 100 in a cross-flow arrangement relative to the airflow, indicated by arrow 405. The second fluid passes into the chamber 205 of manifold 202 of the second tube bank 200 through at least one inlet 223. From manifold 202, the second fluid flows through the second portion **206*b* of heat exchange tube segments 206, to chamber 209 of the second manifold 204 and outlet 222. As the fluids pass simultaneously through the second tube bank 200, the first fluid and the second fluid are approximately at the same temperature to minimize the cross-conduction effect, and therefore improve the performance of the heat exchanger 20**.

Although the first tube bank 100 and the second tube bank 200 are depicted with a certain flow configuration relative to the air flow A, other configurations are within the scope of the invention.

Figure 5:
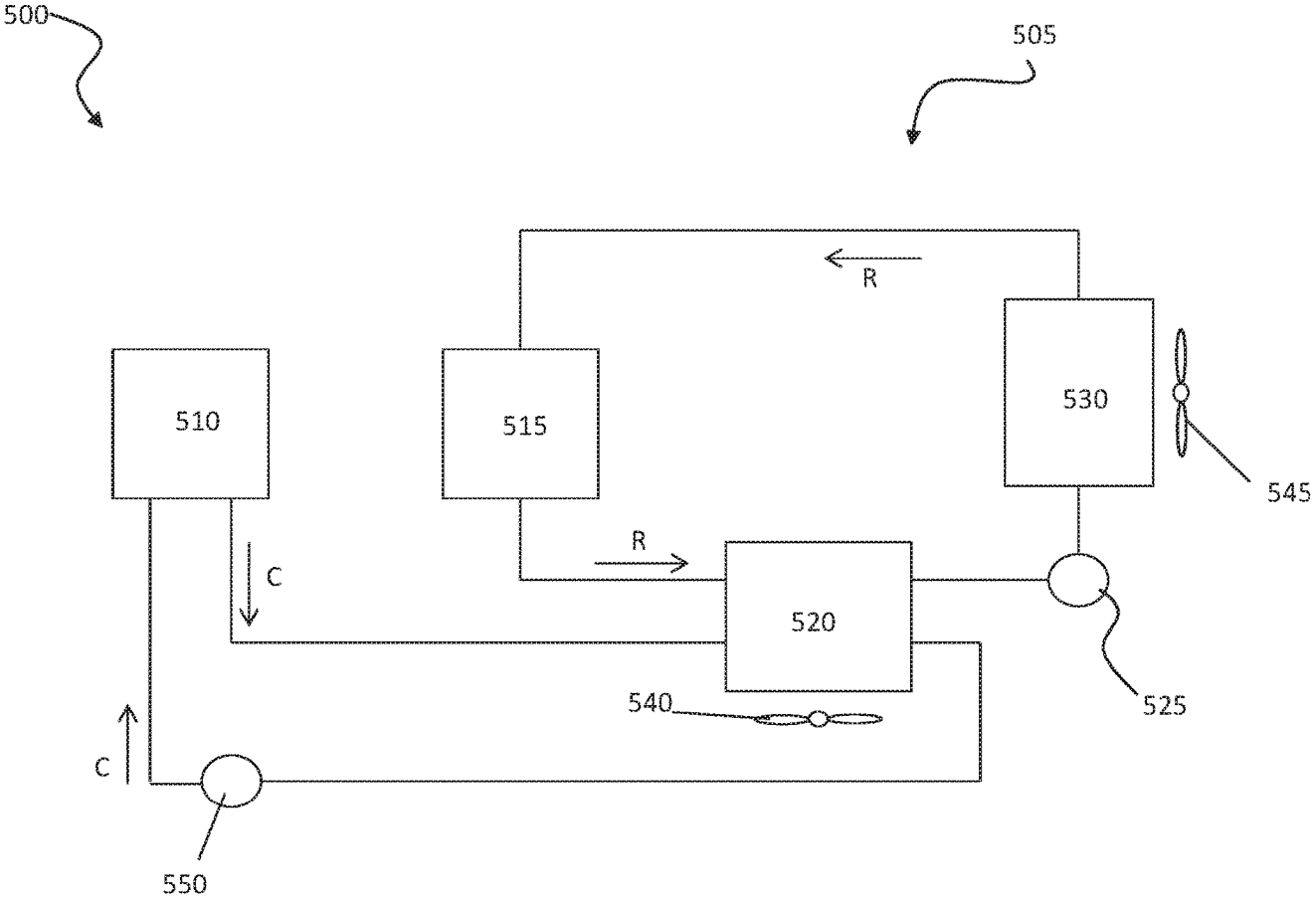
FIG. 5 is a schematic diagram of a transport refrigeration system according to an embodiment of the invention.

The multiple bank flattened tube finned heat exchanger 20 may be integrated into a refrigeration system to improve the overall efficiency of the system. Referring now to FIG. 5, an example of a transport refrigeration system 500 configured to control conditions (i.e. temperature or humidity) associated with a mobile refrigerated cargo box, such as the cargo space of a truck, trailer, or container is provided. The transport refrigeration system 500 includes a transport refrigeration unit (TRU) 505 and a prime mover 510, such as a fuel-fired internal combustion engine for example. In one embodiment, the prime mover 510 comprises a diesel engine equipped with a combustion air pressurization apparatus (not shown), such as a turbo-charger or a super-charger for example. The turbo-charger and super-charger are configured to boost the pressure of atmospheric air to supply pressurized combustion air for combusting fuel in the engine.

The TRU 505 functions in a conventional manner to establish and regulate a desired product storage temperature within the refrigerated cargo space wherein perishable products, such as food, pharmaceuticals, and other temperature sensitive cargo for example, are stowed for transport. The TRU 505 includes a refrigeration compression device 515, a heat rejection heat exchanger 520, an expansion device 525, and a heat absorption heat exchanger 530 connected to form a closed loop refrigeration circuit. The TRU 505 also includes one or more fans 540, 545 associated with the heat rejection heat exchanger 520 and the heat absorption heat exchanger 530 respectively. In the illustrated, non-limiting embodiment, the heat rejection heat exchanger 520 is a multiple bank flattened tube finned heat exchanger 20.

The heat rejection heat exchanger 520 is also fluidly coupled to a second fluid circuit, such as a coolant circuit of the prime mover 510 for example. The heat rejection heat exchanger 520 may be configured to function in a manner similar to a radiator to reject the heat absorbed by the coolant from the prime mover 510. A pump 550 circulates coolant between the prime mover 510 and the heat rejection heat exchanger 520. Although a particular configuration of a transportation refrigeration system 500 is illustrated and described herein, other fluid circuits, such as of a turbo-charger, a variable frequency drive, or another auxiliary unit for example, may be fluidly and thermally coupled at a multiple bank flattened tube finned heat exchanger 20.

Referring again to the heat exchanger in FIG. 4, the refrigerant R may be provided through inlet 221 to chamber 203 of the first manifold 202. The refrigerant is configured to pass through the first portion 206*a* of heat exchange tube segments 206 into chamber 207 of the second manifold 204. From the second manifold 204, the refrigerant R is provided to the second manifold 104 of the first tube bank 100. The refrigerant R may then pass through the heat exchanger tube segments 106 of the first tube bank 100 in a first pass configuration to manifold 102 and outlet 122 (FIG. 3). Alternatively, the refrigerant R may pass through the lower portion 106*a* of the tube segments 106 to the first manifold 102, and back to the second manifold 104, and outlet 122*a*, in a two-pass configuration (FIG. 3*a*). From either outlet 122 or outlet 122*a*, the refrigerant is returned to the refrigeration system.

Coolant from the coolant circuit may be provided through inlet 223 to chamber 205 of the first manifold 202 of the second tube bank 200. The coolant C passes through the second portion 206*b* of the heat exchange tube segments 206 to chamber 209 of the second manifold 204, from where the coolant C is returned to the coolant circuit through at least one outlet 222. The coolant C in the second portion 206*b* of heat exchanger tube segments 206 may be configured to flow in either a single-pass or multi-pass flow arrangement.

In the described embodiment, the first portion 206*a* of tube segments 206 of the second tube bank 200 is configured to de-superheat and initiate condensing of the refrigerant R and the second portion 206*b* of tube segments 206 of the second tube bank 200 is configured to cool the coolant C in place of a separate radiator. The first tube bank 100 of the heat exchanger 20 is dedicated to the condensing and sub-cooling of the refrigerant R. Such an arrangement prevents cross-conduction from the second slab 200 to the first slab 100, since hot desuperheating refrigerant R and hot engine coolant C are contained within the second slab 200 and have limited cross-conduction connection to the relatively cool condensing and subcooling refrigerant within the first slab 100. Other configurations where the flow of refrigerant R and coolant C through a multiple bank flattened tube finned heat exchanger 20 are reversed and still be considered within the scope of the invention.

Figure 6:
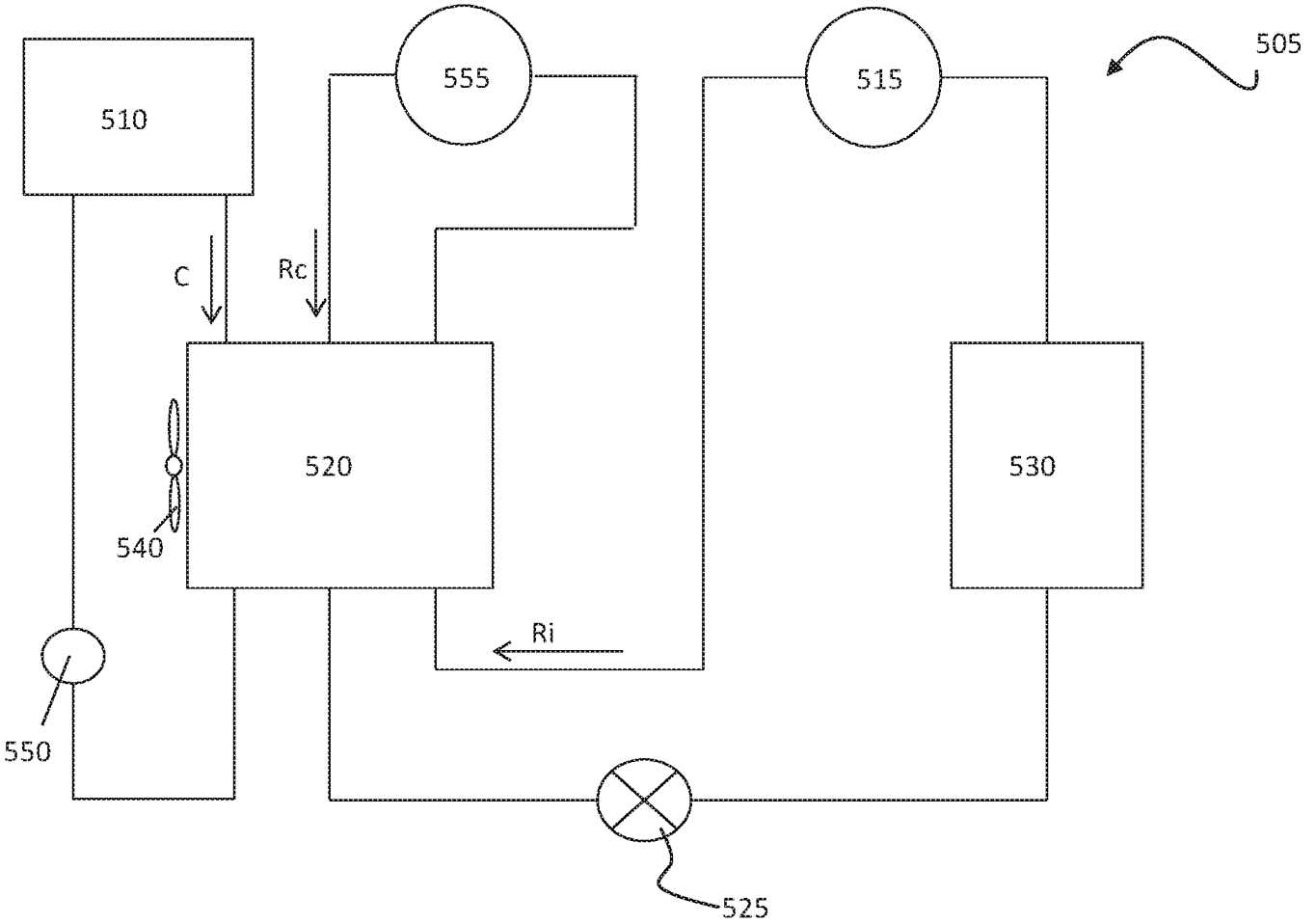
FIG. 6 is a schematic diagram of a transport refrigeration unit including an intercooler according to an embodiment of the invention.

In another embodiment, illustrated in FIG. 6, the TRU 505 of the transport refrigeration system 500 includes a second refrigerant compressor 555 having a second compression stage arranged between the first compressor 515, having a first compression stage, and the heat rejection heat exchanger 520. Alternatively, the refrigeration system 500 may include a single compressor having a first compression stage indicated by 515 and a second compression stage indicated by 555. The flow of refrigerant Ri from the first compressor 515 is configured to flow through a portion of the heat rejecting heat exchanger 520 before being supplied to the second compressor 555. As a result, the heat rejection heat exchanger 520 operates as an intercooler for the refrigerant Ri. The heat rejection heat exchanger 520 may also be fluidly coupled to the coolant circuit such that the refrigerant from the first compressor Ri, the refrigerant from the second compressor Rc and the coolant are all configured to flow through the heat rejection heat exchanger 520 simultaneously.

Figure 7:
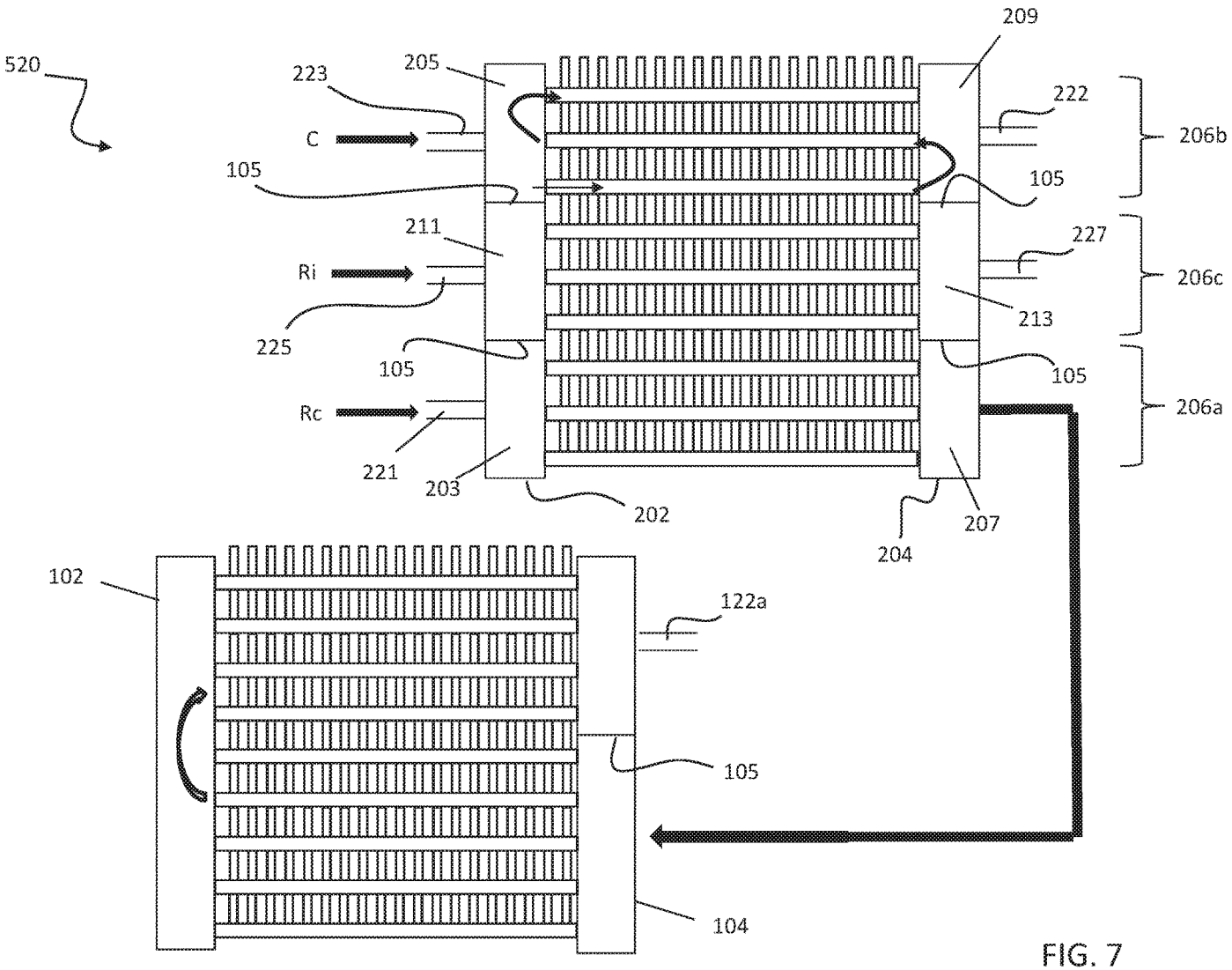
FIG. 7 is an exploded front view of a multiple tube bank flattened tube finned heat exchanger configured for use with the transportation refrigeration unit of FIG. 6.

One configuration of the heat rejection heat exchanger 520 of the transport refrigeration system 500 of FIG. 6 is illustrated in more detail in FIG. 7. The heat rejection heat exchanger 520 is a multiple bank flattened tube finned heat exchanger 20 and the second tube bank 200 includes three portions 206*a*, 206*b*, 206*c* of heat exchanger tube segments 206, each portion extending between a pair of opposite chambers 203, 205, 211, 207, 209, 213 arranged within the first and second manifold 202, 204 respectively. The refrigerant Rc from the second compressor 555 is provided through at least one inlet 221 to chamber 203 of the first manifold 202 and passes through the first portion 206*a* of heat exchanger tube segments 206 into chamber 207 of the second manifold 204. From the second manifold 204, the refrigerant Rc is provided to the first tube bank 100 where it flows in either a single pass or a multi-pass configuration (shown) and returns to the refrigerant system via outlet 122 or 122*a* respectively. The coolant C may be provided through at least one inlet 223 to chamber 205 of the first manifold 202 of the second tube bank 200. The coolant C passes through the second portion 206*b* of the heat exchange tube segments 206 to chamber 209 of the second manifold 204, from where the coolant C is returned to the coolant circuit through at least one outlet 222. The intercooler refrigerant Ri coolant C may be provided through inlet 225 to chamber 211 of the first manifold 202. The intercooler refrigerant Ri passes through the third portion 206*c* of the heat exchange tube segments 206 to chamber 213 of the second manifold 204 from where the intercooler refrigerant Ri provided to the second compressor 555 through outlet 227.

Figure 8:
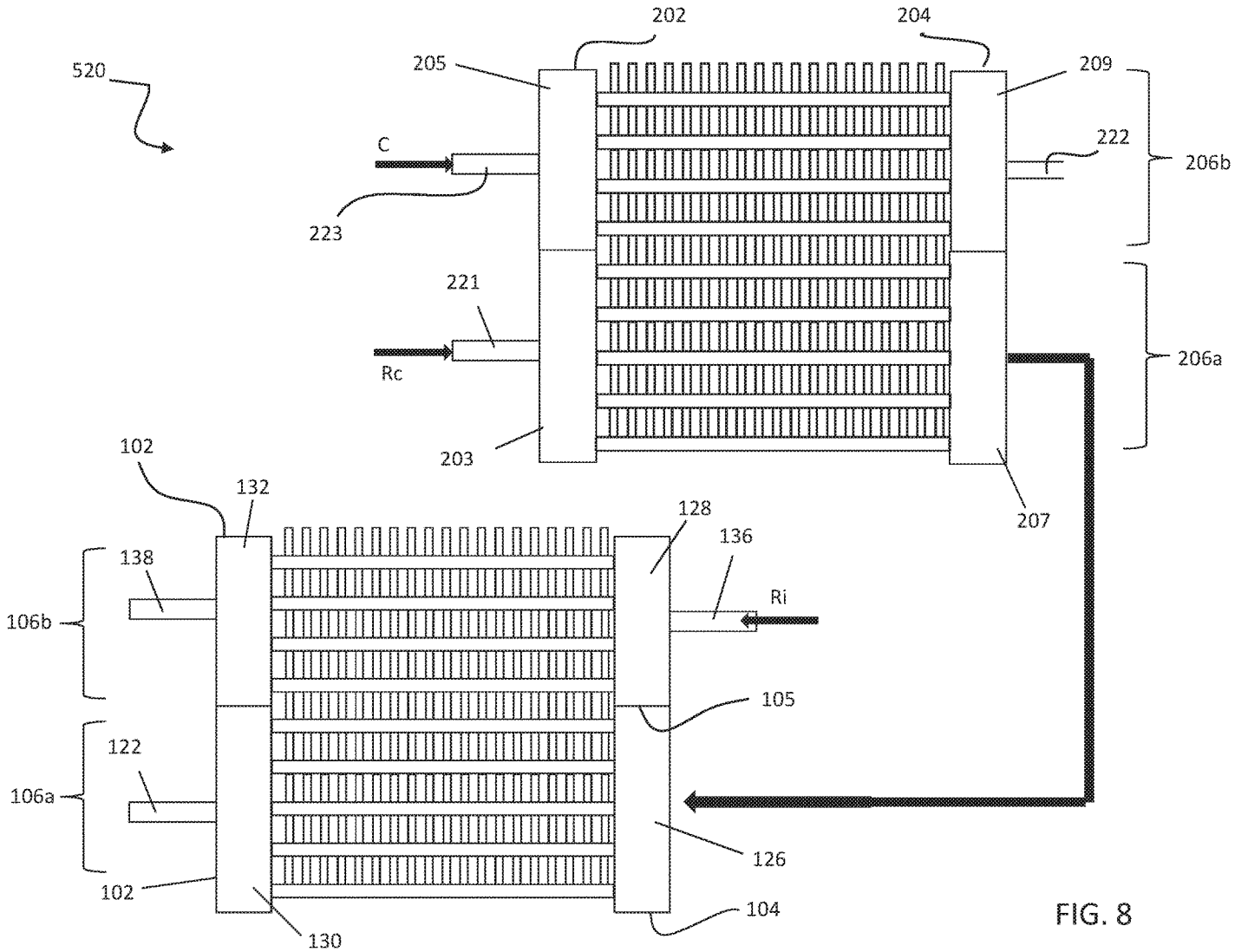
FIG. 8 is an exploded front view of another multiple tube bank flattened tube finned heat exchanger configured for use with the transportation refrigeration unit of FIG. 6.

Another configuration of the heat rejection heat exchanger 520 of the transport refrigeration system 500 of FIG. 6 is illustrated in more detail in FIG. 8. The refrigerant Rc from the second compressor 555 may be provided through an inlet 221 to chamber 203 of the first manifold 202 and pass through the first portion 206*a* of heat exchange tube segments 206 into chamber 207 of the second manifold 204. From the second manifold 204, the refrigerant Rc is provided to a chamber 126 of the second manifold 104 of the first tube bank 100. The refrigerant Rc passes through a first lower portion 106*a* of heat exchange tube segments 106 to chamber 130 of the first manifold 102 and is provided back to the refrigeration system 500 via an outlet 122. The coolant C may be provided through an inlet 223 to chamber 205 of the first manifold 202 of the second tube bank 200. The coolant C passes through the second portion 206*b* of the heat exchange tube segments 206 to chamber 209 of the second manifold 204, from where the coolant C is returned to the coolant circuit through at least one outlet 222.

In the illustrated, non-limiting embodiment, the intercooler refrigerant Ri from the first compressor 515 is provided through an inlet 136 to a chamber 128 of the second manifold 104 of the first tube bank 100. The intercooler refrigerant Ri is configured to flow through the second, upper portion 106*b* of heat exchange tube segments 106 to chamber 132 of the first manifold 102. From the first manifold 102, the intercooler refrigerant is returned to the refrigerant system via outlet 138.

By integrating two or more fluid circuits into a multiple bank flattened fin heat exchanger 20, the manufacturing and logistical complexity of the fluid circuits is greatly reduced. In addition, integration of two previously separate heat exchangers into a single multiple bank flattened fin heat exchanger 20 results in improved corrosion durability and a significant cost reduction. It is understood that the invention can be applied to any other portable or engine driven system where another auxiliary heat exchanger is utilized to reject heat.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims. In particular, similar principals and ratios may be extended to the rooftops/chiller applications as well as vertical package units.

What is claimed is:

1. A transport refrigeration system comprising:

a prime mover; and a refrigeration unit including a compressor including a first compressor stage and a second compressor stage and a heat exchanger, the heat exchanger being arranged in fluid communication with the prime mover, the heat exchanger comprising:

a first tube bank including a first group of flattened tube segments extending longitudinally in a spaced, parallel relationship, each flattened tube segment of the first group of flattened tube segments defines a plurality of flow passages;

a second tube bank including a second group of flattened tube segments and a third group of flattened tube segments extending longitudinally in a spaced, parallel relationship, each of the second group of flattened tube segments and the third group of flattened tube segments defines a plurality of flow passages, the second tube bank disposed behind the first tube bank with a leading edge of the second tube bank spaced from a trailing edge of the first tube bank, the second group of flattened tube segments is fluidly coupled to the first tube bank and is configured to receive a first fluid and the third group of flattened tube segments is configured to receive a second fluid, the third group of flattened tube segments being arranged in fluid communication with the prime mover;

wherein at least one of the first tube bank and the second tube bank further comprises a fourth group of flattened tube segments, the fourth group of flattened tube segments being configured to receive the first fluid, wherein the first fluid is provided to the fourth group of flattened tube segments from the first compression stage and has a different temperature than the first fluid provided to the second group of flattened tube segments; and a fan configured to provide an airflow across the first tube bank and the second tube bank sequentially.

2. The transport refrigeration system according to claim 1, wherein the first fluid is configured to flow through the second group of flattened tube segments of the second bank and at least a portion of the first group of flattened tube segments of the first tube bank in a cross-counterflow direction relative to the airflow and the second fluid is configured to flow through the third group of flattened tube segments of the second tube bank in a cross-flow direction relative to the airflow.

3. The transport refrigeration system according to claim 1, wherein the first fluid is configured to make at least two passes, at least one pass is provided in the second group of flattened tubes of the second tube bank and at least one pass is provided in the first group of flattened tubes of the first tube bank.

4. The transport refrigeration system according to claim 3, wherein the first fluid is configured to make more than one pass in the first tube bank.

5. The transport refrigeration system according to claim 1, wherein the second fluid is configured to make a single pass through the third group of flattened tubes of the second tube bank.

6. The transport refrigeration system according to claim 1, wherein the second fluid is configured to make multiple passes through the third group of flattened tubes of the second tube bank.

7. The transport refrigeration system according to claim 1, wherein the flattened tube segments of the second tube bank have a different width than the flattened tube segments of the first tube bank.

8. The transport refrigeration system according to claim 1, wherein the first fluid is one of refrigerant and coolant.

9. The transport refrigeration system according to claim 8, wherein the coolant is one of water, ethylene glycol and propylene glycol.

10. The transport refrigeration system according to claim 1, wherein the second fluid is one of refrigerant and coolant.

11. The transport refrigeration system according to claim 1, wherein the first fluid received in the second group of flattened tube segments of the second tube bank is refrigerant provided from the second compression stage.

12. The transport refrigeration system according to claim 1, wherein the heat exchanger is configured to function as an intercooler for the refrigerant provided from the first compression stage.

* * * * *